US010843318B2

(12) United States Patent
Kobori et al.

(10) Patent No.: US 10,843,318 B2
(45) Date of Patent: Nov. 24, 2020

(54) FASTENER DRIVING MACHINE

(71) Applicant: HITACHI KOKI CO., LTD., Tokyo (JP)

(72) Inventors: Kenji Kobori, Ibaraki (JP); Shinichirou Sato, Ibaraki (JP); Takashi Ueda, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 193 days.

(21) Appl. No.: 15/570,737

(22) PCT Filed: Apr. 1, 2016

(86) PCT No.: PCT/JP2016/060935

§ 371 (c)(1),
(2) Date: Oct. 30, 2017

(87) PCT Pub. No.: WO2016/174994

PCT Pub. Date: Nov. 3, 2016

(65) Prior Publication Data

US 2018/0290279 A1 Oct. 11, 2018

(30) Foreign Application Priority Data

Apr. 30, 2015 (JP) ..... 2015-093512

(51) Int. Cl.
*B25C 1/04* (2006.01)
*B25C 1/06* (2006.01)
*B25C 1/00* (2006.01)

(52) U.S. Cl.
CPC ..... *B25C 1/047* (2013.01); *B25C 1/06* (2013.01); *B25C 1/001* (2013.01)

(58) Field of Classification Search
CPC ..... B25C 1/047; B25C 1/06; B25C 1/001
(Continued)

(56) References Cited

U.S. PATENT DOCUMENTS 3,572,985 A * 3/1971 Runge ..... F01C 11/004 418/138
4,083,663 A * 4/1978 Montalvo ..... F01C 1/28 123/222

(Continued)

FOREIGN PATENT DOCUMENTS

JP H09-094769 A 4/1997
JP 2014-069289 A 4/2014

(Continued)

OTHER PUBLICATIONS

Search Report issued in corresponding International Patent Application No. PCT/JP2016/060935, dated Jun. 21, 2016.

*Primary Examiner* — Robert F Long
(74) *Attorney, Agent, or Firm* — McDermott Will & Emery LLP

(57) ABSTRACT

In order to make it possible to easily carry out filling up of a compressed air to a compression chamber without making a fastener driving machine larger in size, there is provided a fastener driving machine that includes a cylinder that forms a piston chamber defined by a piston and drives a driver blade by the piston. The housing has a cylinder case part for housing a cylinder, and a handle part. A pressure accumulating container is provided on the cylinder. The pressure accumulating container includes a bottom wall portion and a top wall portion. A compression chamber that communicates with the piston chamber is provided therein.

15 Claims, 17 Drawing Sheets

(58) Field of Classification Search
USPC ..... 227/130; 91/169, 217, 423, 442, 469; 173/90
See application file for complete search history.

(56) References Cited

U.S. PATENT DOCUMENTS 4,624,401 A * 11/1986 Gassner ..... B25C 3/002 227/120
4,690,225 A * 9/1987 Tupitsyn ..... B25D 9/04 173/14
4,747,338 A * 5/1988 Crutcher ..... B25C 1/042 91/461
5,134,812 A * 8/1992 Hoffman ..... F16B 1/0014 403/305
5,333,884 A * 8/1994 Miyaoh ..... F16J 15/061 277/598
5,365,713 A * 11/1994 Nicholas ..... E04B 1/681 52/396.03
5,375,666 A * 12/1994 Pettet ..... A01D 34/905 173/162.1
5,437,339 A * 8/1995 Tanaka ..... B25C 1/047 173/210
5,692,574 A * 12/1997 Terada ..... B25D 17/043 173/162.2
5,720,423 A 2/1998 Kondo et al.
5,941,412 A * 8/1999 Mahoney ..... B65D 43/166 220/845
5,957,100 A * 9/1999 Frohwerk ..... F02F 7/006 123/90.37
6,007,373 A * 12/1999 Chew ..... H01R 13/6675 439/500
6,085,709 A * 7/2000 Freese ..... F02B 77/13 123/195 C
6,785,950 B1 * 9/2004 Scirbona ..... B25D 11/102 173/203
6,814,154 B2 * 11/2004 Chou ..... B25B 21/00 173/216
7,073,795 B2 * 7/2006 Ueta ..... F16J 15/0818 277/591
7,827,950 B2 * 11/2010 Hu ..... F02F 7/006 123/193.5
8,141,531 B2 * 3/2012 Smith ..... F02F 7/006 123/193.5
8,833,486 B2 * 9/2014 Krauter ..... B25F 5/006 173/162.1
2001/0043007 A1 * 11/2001 Jang ..... B25D 9/145 299/69
2002/0020595 A1 * 2/2002 Adamek ..... F16F 9/465 188/280
2004/0033148 A1 * 2/2004 Dalland ..... F15B 15/1428 417/539
2004/0040809 A1 * 3/2004 Gustavsson ..... F16F 1/3713 188/379
2004/0134960 A1 * 7/2004 Schiestl ..... B25C 1/08 227/10
2005/0193972 A1 * 9/2005 vom Stein ..... B29C 45/1418 123/90.38
2005/0284649 A1 * 12/2005 Sabates ..... A22B 3/02 173/212
2006/0016845 A1 * 1/2006 Ishizawa ..... B25C 1/042 227/130
2006/0042573 A1 * 3/2006 Nishikawa ..... B25C 1/08 123/46 H
2008/0224421 A1 * 9/2008 Niblett ..... B25C 1/047 277/638
2009/0032564 A1 * 2/2009 Takemura ..... B25C 1/08 227/10
2010/0092322 A1 * 4/2010 Furusho ..... F01C 17/06 418/63
2010/0258327 A1 * 10/2010 Esenwein ..... H01R 39/381 173/217
2011/0002803 A1 * 1/2011 Kumakura ..... F01C 21/18 418/60
2011/0139848 A1 * 6/2011 Rousson ..... B25C 1/08 227/10
2013/0199813 A1 * 8/2013 Zimmerman ..... E02D 7/10 173/200
2013/0270319 A1 * 10/2013 Gauger ..... B25C 1/08 227/2
2014/0190683 A1 * 7/2014 Hallunbæk ..... E21B 33/1277 166/122
2015/0102084 A1 * 4/2015 Zhao ..... B25C 1/08 227/10
2015/0176506 A1 * 6/2015 Miyazono ..... F02D 15/02 123/48 A
2015/0202755 A1 7/2015 Tanji
2015/0352702 A1 * 12/2015 Chien ..... B25C 1/06 227/130
2016/0169251 A1 * 6/2016 Prouzet ..... B64C 1/1407 74/99 R
2016/0169582 A1 * 6/2016 Schantl ..... F27D 3/1527
2016/0229043 A1 * 8/2016 Wyler ..... B25C 1/06
2017/0087703 A1 * 3/2017 Moore ..... B25D 17/00
2017/0167962 A1 * 6/2017 Moore ..... B25D 9/00
2020/0122308 A1 * 4/2020 Bradley ..... F15B 21/048

FOREIGN PATENT DOCUMENTS

WO 2011/010512 A1 1/2011
WO 2015/037299 A1 3/2015

* cited by examiner

11: HOUSING
12: CYLINDER
41: PRESSURE ACCUMULATING CONTAINER
42: BOTTOM WALL PART
45: COMPRESSION CHAMBER
71: FILLING VALVE
81: RELIEF VALVE (A)

(B)

(A)

(B)

FASTENER DRIVING MACHINE

CROSS REFERENCE

This application is the U.S. National Phase under 35 U.S.C. § 371 of International Application No. PCT/JP2016/060935, filed on Apr. 1, 2016, which claims the benefit of Japanese Application No. 2015-093512, filed on Apr. 30, 2015, the entire contents of each are hereby incorporated by reference.

TECHNICAL FIELD

The present invention relates to a fastener driving machine for driving a fastener, such as a nail and a staple to a member into be driven.

BACKGROUND ART

A fastener driving machine for driving a fastener such as a nail into a member to be driven such as lumber has a driver blade that strikes the fastener from an injection port of the fastener driving machine. In a fastener driving machine using a compressed air as a driving source of a driver blade, the driver blade is driven by a piston. When the driver blade is driven, a fastener is driven into a member to be driven by means of the driver blade. The fastener driving machine has a magazine that houses a large number of fasteners, and the fasteners are fed from the magazine to the front of the driver blade. Patent Document 1 discloses a fastener driving machine provided with a piston. The piston has a cylindrical part and an end wall part, and is assembled in a cylinder so that the piston can freely reciprocate.

Patent Document 1 discloses a fastener driving machine in which bellows stretchable in an axial direction thereof is assembled in a cylinder. A compressed air is sealed in the bellows. In this type of fastener driving machine, one end portion of the bellows is fixed at an end wall part of a piston, and the other end portion thereof is fixed to a housing provided at a top part side of the cylinder. Patent Document 1 further discloses a fastener driving machine in which a pressure accumulating chamber is formed by a piston and a cylinder. In this type of fastener driving machine, a flange is provided at an open end of the piston, and the flange is in sliding contact with an inner circumferential surface of the cylinder. In order to cause the piston to move backward in a contraction direction thereof against thrust applied to the piston in a direction to be struck by the bellows and the compressed air in the pressure accumulating chamber, a cam rotationally driven by a motor engages with the piston.

RELATED ART DOCUMENTS

Patent Documents

Patent Document 1: Japanese Patent Application Publication No. 2014-69289

SUMMARY OF THE INVENTION

Problems to be Solved by the Invention

This type of fastener driving machine in which the bellows is assembled in the inside of the cylinder has a double structure in which a striking portion for a driver blade is composed of a bellows and a cylinder. The type of fastener driving machine in which a pressure accumulating chamber is defined by the piston and the cylinder has a double structure in which the striking portion is composed of the piston and the cylinder. The fastener driving machine with such a double structure has a complex structure. Further, in the fastener driving machine in which the pressure accumulating chamber inside the bellows is caused to expand and contract in an axial direction thereof or the pressure accumulating chamber is caused to expand and contract by means of the piston and the cylinder, in order to ensure a volume of the pressure accumulating chamber, a dimension of the fastener driving machine in a driving direction, that is, a vertical dimension thereof has to be made longer. For this reason, the vertical dimension of the fastener driving machine becomes larger.

In the fastener driving machine in which the pressure accumulating chamber is formed by the piston and the cylinder, a filling valve is assembled at an end wall part of the cylinder of a top part side in order to fill the inside of the pressure accumulating chamber with a compressed gas. The end wall part is assembled inside the housing. In a case where the filling valve is assembled at the end wall part, a length of the cylinder including the end wall part becomes longer, and a vertical dimension of the fastener driving machine thus becomes larger. Further, in a case where the filling valve is provided at the end wall part, it is impossible to easily carry out a filling operation of the compressed gas by using the filling valve.

It is an object of the present invention to make it possible to easily carryout filling up of a compressed air to a compression chamber without making a fastener driving machine larger in size.

Means for Solving the Problems

A fastener driving machine according to the present invention is a fastener driving machine provided with a cylinder in which a piston is allowed to freely reciprocate, the cylinder forming a piston chamber defined by the piston, the fastener driving machine being configured to drive a driver blade to drive a fastener to a member to be driven by means of the piston, the fastener driving machine including: a housing provided with a cylinder case part and a handle part, the cylinder case part housing the cylinder, the handle part being continued to the cylinder case part; a bottom wall portion extending outward from the cylinder; a top wall portion that faces the cylinder and the bottom wall portion; a pressure accumulating container configured to form a compression chamber that communicates with the piston chamber; and a filling valve provided on the bottom wall portion to fill the compression chamber with a gas.

Advantageous Effects of the Invention

The pressure accumulating container that forms the compression chamber communicated with the cylinder chamber has the bottom wall portion extending outward in a radial direction of the cylinder. The filling valve for filling the compression chamber with a gas is provided in a space between the cylinder and the cylinder case part. This makes it possible to dispose the filling valve in the housing by using the space between the cylinder and the cylinder case part. It is possible to easily carryout filling up of a compressed air to the compression chamber without making the fastener driving machine larger in size.

BRIEF DESCRIPTIONS OF THE DRAWINGS

DESCRIPTIONS OF THE EMBODIMENTS

Figure 1:
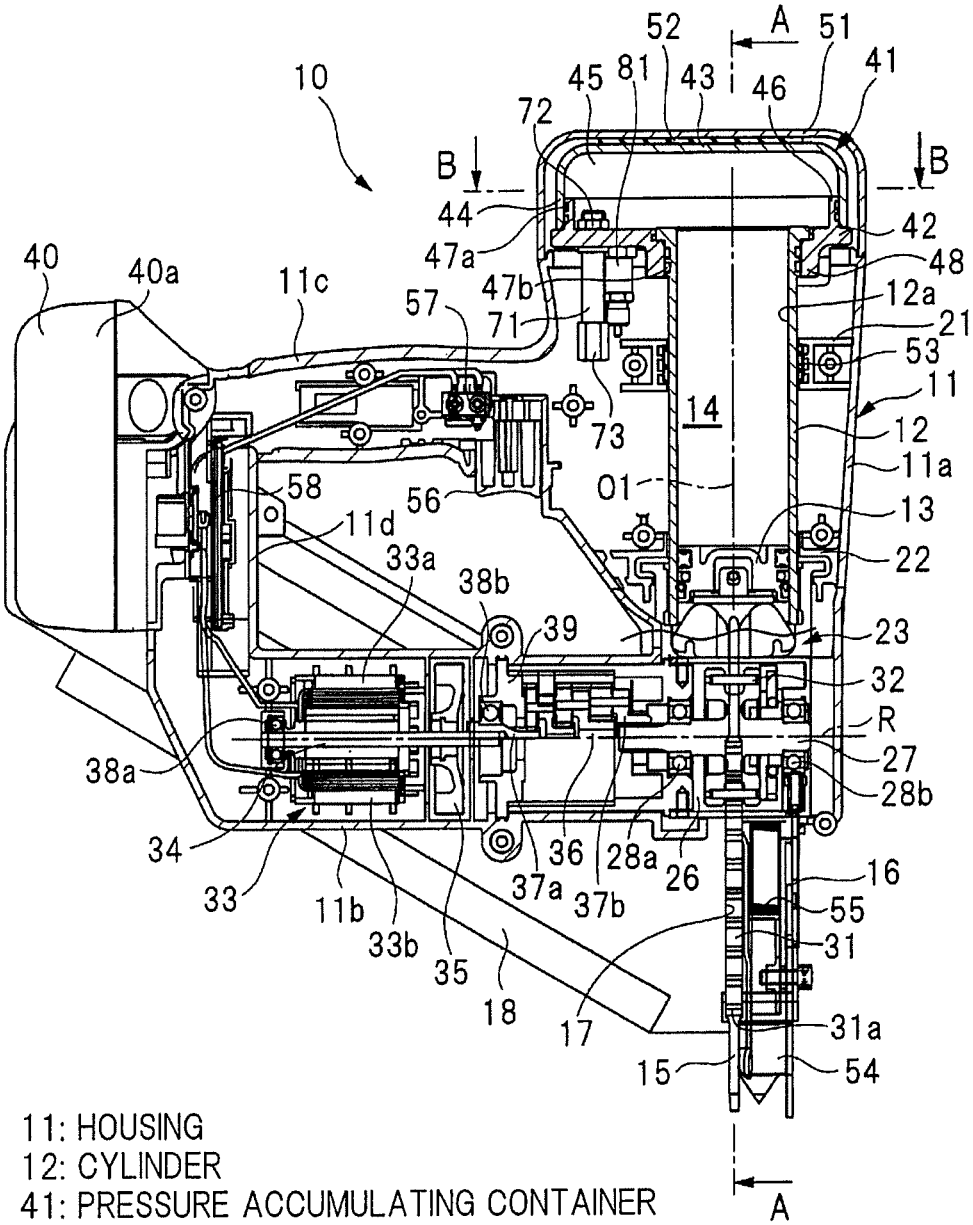
FIG. 1 is a sectional view of a fastener driving machine according to one embodiment when viewed from a side surface thereof, and shows a state where a driver blade projects.

Hereinafter, embodiments of the present invention will be described in detail on the basis of the drawings. In each of the drawings, the same reference numerals are assigned to common members, respectively.

A fastener driving machine 10 shown in FIG. 1 to FIG. 5 has a housing 11. The housing 11 includes a cylinder case part 11*a* and a motor case part 11*b*. The cylinder case part 11*a* houses a cylinder 12. The motor case part 11*b* is integrated with a tip part of the cylinder case part 11*a*. A handle part 11*c* is integrated with a top part side of the cylinder case part 11*a* along the motor case part 11*b*. A coupling part 11*d* is integrally provided between a tip part of the handle part 11*c* and a tip part of the motor case part 11*b*. In this manner, the housing 11 includes the cylinder case part 11*a*, the motor case part 11*b*, the handle part 11*c*, and the coupling part 11*d*. The housing 11 has two housing half body each of which is formed of a resin such as nylon or polycarbonate. The housing 11 is assembled by coming face to face with the two housing half bodies.

The cylinder 12 is housed in the cylinder case part 11*a*. A piston 13 is provided in a cylinder hole 12*a* so as to be allowed to reciprocate in an axial direction thereof. In a case where in FIG. 1 a top end part the cylinder 12 is referred to as a top part and a bottom end part of the cylinder 12 is referred to as a tip part, the piston 13 reciprocates between the tip part and the top part of the cylinder 12. A piston chamber 14 is defined by the cylinder hole 12*a* and a top surface of the piston 13. A driver blade 15 is coupled to the piston 13, and the driver blade 15 is supported in an injection port 17 of a nose part 16 provided on the housing 11 so that the driver blade 15 can freely reciprocate in an axial direction thereof. A magazine 18 that houses a large number of fasteners therein is mounted on the housing 11. The fasteners in the magazine 18 are supplied to the injection port 17 one by one. The fastener supplied to the injection port 17 is driven into a member to be driven, such as lumber or a gypsum board, by the driver blade 15 coupled to the piston 13. When a driving operation is carried out, an operator grips the handle part 11*c*, and operates the fastener driving machine 10 while causing the cylinder 12 to face to the front.

Figure 2:
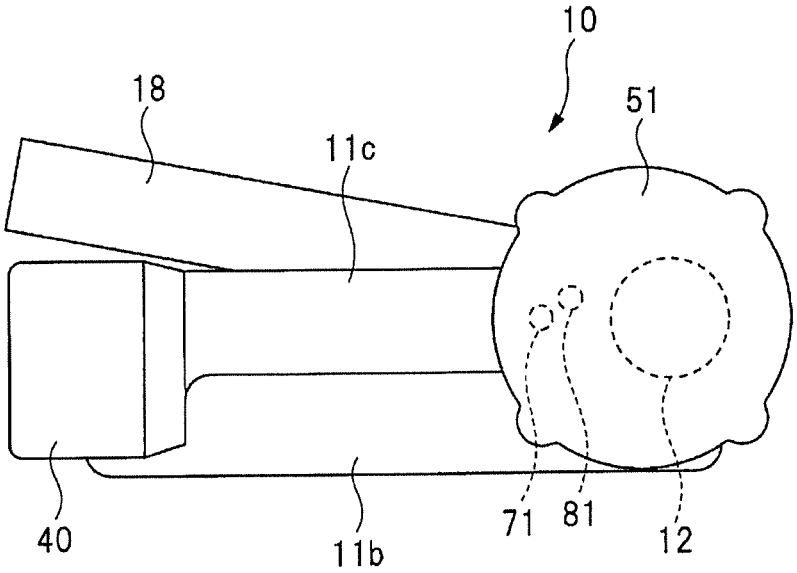
FIG. 2 is a plan view of FIG. 1.

As shown in FIG. 2, the motor case part 11*b* is arranged so as to be shifted to one side in a width direction of the fastener driving machine 10 with respect to the handle part 11*c*, and the magazine 18 is arranged so as to be tilted at the opposite side in the width direction thereof with respect to the motor case part 11*b*. As shown in FIG. 1, the magazine 18 is tilted downward from a rear end part to the tip part. However, the magazine 18 may be arranged at a right angle relative to the cylinder 12.

Figure 3:
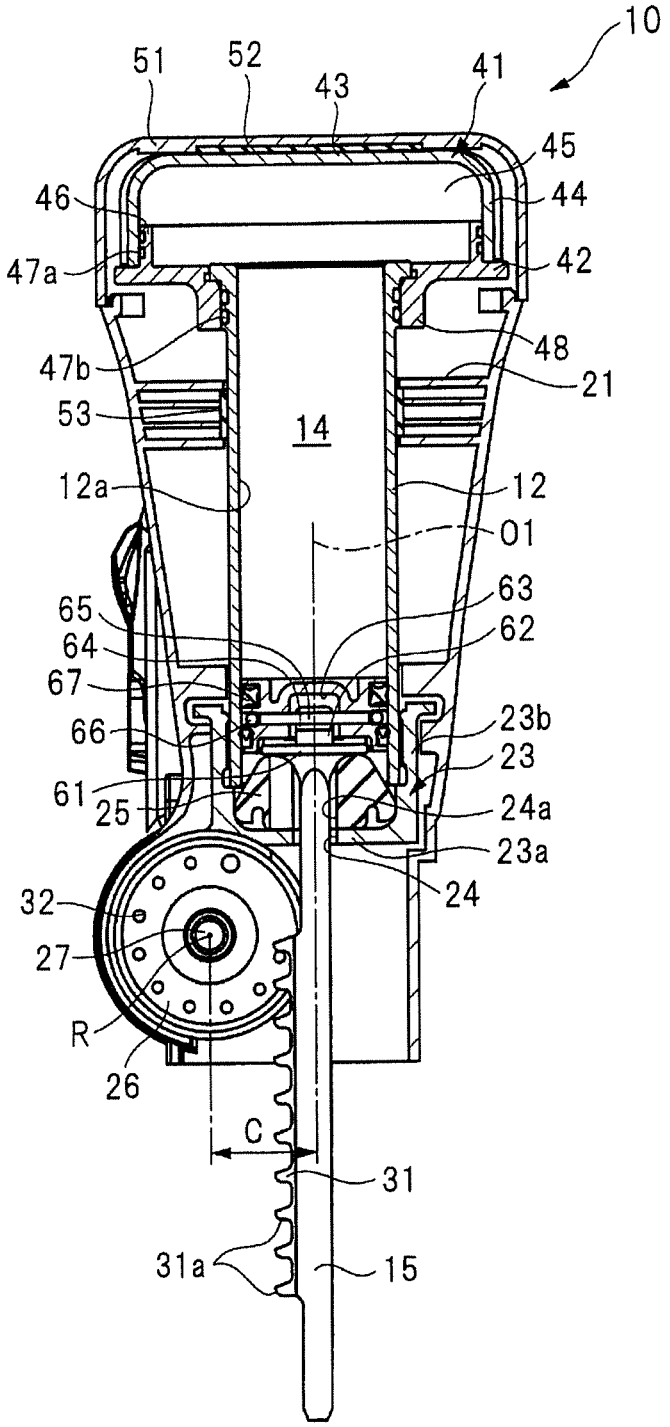
FIG. 3 is a sectional view taken along an A-A line of FIG. 1.
Figure 4:
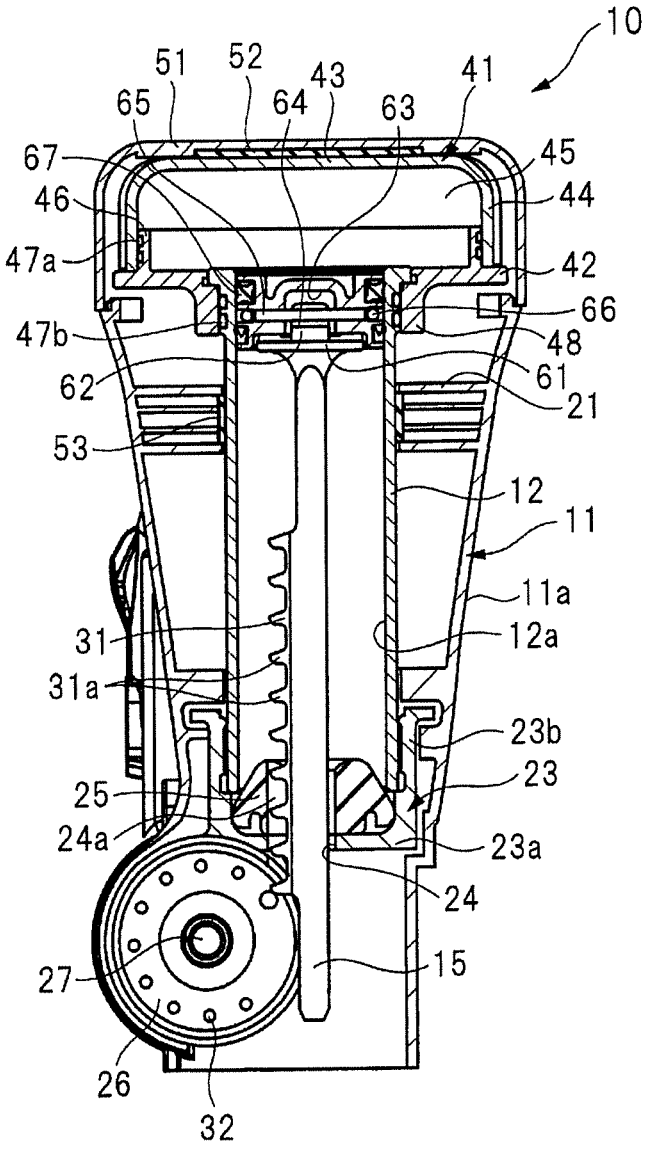
FIG. 4 is a sectional view showing a state where the driver blade is moved backward.

A protruding portion 21 and a protruding portion 22 are provided in the cylinder case part 11*a*. The protruding portion 21 abuts on an outer peripheral surface of the cylinder 12 at the top part side thereof. The protruding portion 22 abuts on the outer peripheral surface of the cylinder 12 at the tip part side. The cylinder 12 is fixed in the cylinder case part 11*a* by means of the protruding portions 21, 22. As shown in FIG. 3 and FIG. 4, a holder 23 provided with an end wall part 23*a* and a cylindrical part 23*b* is mounted on the tip part of the cylinder 12. The driver blade 15 penetrates a through hole 24 provided in the end wall part 23*a*.

FIG. 1 and FIG. 3 show a state where the driver blade 15 is driven by the piston 13 to become a forward limit position (bottom dead point). FIG. 4 shows a state where the piston 13 becomes a backward limit position (top dead point) by means of the driver blade 15. In order to absorb an impact of the piston 13 when the piston 13 is driven to the tip part of the cylinder 12, a damper 25 made of rubber or urethane is provided in the holder 23. The driver blade 15 penetrates a through hole 24*a* provided in the damper 25.

In order to return the piston 13 to backward limit position shown in FIG. 4, a rotary disk 26 is provided in the motor case part 11*b*. The rotary disk 26 is provided on a drive shaft 27. As shown in FIG. 1, the drive shaft 27 is rotatably supported by bearings 28*a*, 28*b* mounted in the motor case part 11*b*. A rack 31 provided with a plurality of rack claws 31*a* is mounted on the driver blade 15, and a plurality of pins 32 that engages with the rack claws 31*a* is mounted on the rotary disk 26 in a circumferential direction at predetermined intervals. As shown in FIG. 1 and FIG. 3, a rotation central shaft R of the rotary disk 26 is shifted by a distance C in a radial direction of the cylinder 12 with respect to a central axis O1 of the cylinder 12, and the rotation central shaft R becomes substantially a right angle relative to the central axis O1. FIG. 1 shows a section of a portion of the rotation central shaft R and a section of a portion of the central axis O1.

In order to rotationally drive the rotary disk 26, an electric motor 33 is fitted to the inside of the motor case part 11*b*, the electric motor 33 has a stator 33*a* and a rotor 33*b*. The stator 33*a* is fixed to the motor case part 11*b*. The rotor 33*b* is rotatably provided in the stator 33*a*. A cooling fan 35 is mounted on a motor shaft 34 provided on the rotor 33*b*. A cooling air for cooling the electric motor 33 is generated in the housing 11 by the cooling fan 35. An air intake hole (not shown in the drawings) through which the outside air is introduced and a discharge hole (not shown in the drawings) through which the air after cooling the motor is discharged are provided in the housing 11.

A planetary gear type speed reducer 36 is fitted to the inside of the motor case part 11*b*. An input shaft 37*a* of the speed reducer 36 is coupled to the motor shaft 34, and an output shaft 37*b* of the speed reducer 36 is coupled to the drive shaft 27. A base end part of the motor shaft 34 is rotatably supported by a bearing 38*a* mounted on the motor case part 11*b*, and the input shaft 37*a* to which a tip part of the motor shaft 34 is coupled is rotatably supported by a bearing 38*b* that is mounted on a speed reducer holder 39.

A battery 40 for supplying an electric power to the electric motor 33 is detachably fitted to a rear end part of the housing 11. The battery 40 has a housing case 40*a* and a plurality of battery cells (not shown in the drawings) that is housed in the housing case 40*a*. Each of the battery cells is a secondary battery that is composed of a lithium-ion battery, a nickel metal hydride battery, a lithium ion polymer battery, nickel-cadmium battery or the like.

Figure 5:
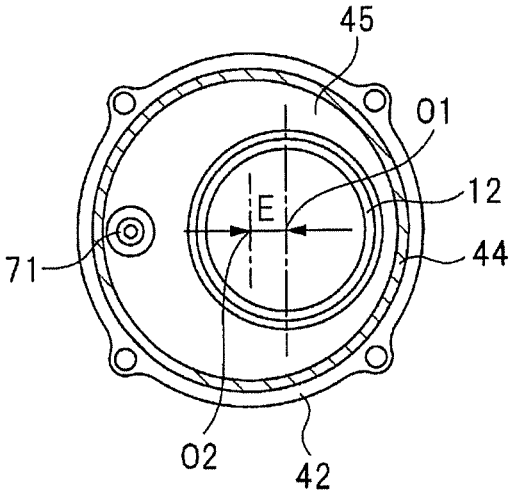
FIG. 5 is a sectional view taken along a B-B line of FIG. 1.

A pressure accumulating container 41 is provided on the cylinder 12 outside the cylinder 12 in the axial direction thereof. The pressure accumulating container 41 has a bottom wall portion 42 that is mounted on the top part of the cylinder 12 and extends outward in the radial direction of the cylinder 12. A cylindrical part 44 with which a top wall portion 43 is integrated is mounted on the bottom wall portion 42, and the top wall portion 43 faces the top part of the cylinder 12 and the bottom wall portion 42. A compression chamber 45 that communicates with the piston chamber 14 is formed inside the pressure accumulating container 41. As shown in FIG. 5, the bottom wall portion 42 is formed by a member whose outer peripheral surface is a round shape. A center O2 of the bottom wall portion 42 is eccentrically provided by an amount of eccentricity E from the central axis O1 of the cylinder 12 toward the handle part 11*c*, and the bottom wall portion 42 is shifted in the radial direction with respect to the cylinder 12. Therefore, the compression chamber 45 of the pressure accumulating container 41 is eccentrically provided with respect to the central axis O1 of the cylinder 12.

The pressure accumulating container 41 has the cylindrical part 44 whose diameter is larger than that of the cylinder 12. Thus, it is possible to shorten a length in a vertical direction containing the cylinder 12 and the pressure accumulating container 41 compared with a case where the compression chamber 45 is formed at the top part side of the cylinder 12. This makes it possible to downsize the fastener driving machine 10.

An annular projecting part 46 to which the cylindrical part 44 is fitted is provided on an inner surface of the bottom wall portion 42, and a space between the projecting part 46 and the cylindrical part 44 is sealed by a sealing member 47*a*. An annular projecting part 48 to which the cylinder 12 is fitted is provided on an outer surface of the bottom wall portion 42. A space between the projecting part 48 and the cylinder 12 is sealed by a sealing member 47*b*. The pressure accumulating container 41 is covered by a cover 51 mounted in the cylinder case part 11*a*. A sheet-like vibration isolation rubber 52 is assembled between the cover 51 and the pressure accumulating container 41. Moreover, an annular vibration isolation rubber 53 is assembled between the protruding portion 21 and the cylinder 12.

The inside of the piston chamber 14 and the compression chamber 45 is filled with an air as a gas. As shown in FIG. 1, in order to drive the piston 13, which becomes the tip part of the cylinder 12, toward the top part, the rotary disk 26 is rotationally driven in a counterclockwise direction in FIG. 3 via the speed reducer 36 by means of the electric motor 33. When the rotary disk 26 is rotated, the pins 32 provided downstream in a rotational direction in turn engage with the rack claws 31*a* shown at a lower side in FIG. 3. When it becomes a state where the pin 32 provided at the most downstream side in the rotational direction engages with the lowermost rack claw 31*a*, as shown in FIG. 4, the piston 13 is driven almost to an opening of the top part of the cylinder 12. In this state, the compressed air within the piston chamber 14 gets into the compression chamber 45, and a pressure of the compressed air in the compression chamber 45 becomes almost the maximum. When the rotary disk 26 is rotationally driven continuously and engagement of the pin 32 and rack claw 31*a* is released, the piston 13 is driven toward the tip part from the top part of the cylinder 12 by means of the pressure of the compressed air in the compression chamber 45. A rotation angle of the rotary disk 26 is detected by an angle detecting sensor (not shown in the drawings).

A push rod (contact arm) 54 is provided on the nose part 16 so that the push rod 54 can freely reciprocate in an axial direction thereof. The push rod 54 is biased by spring force of a helical compression spring 55 in a direction to which the tip part projects. When the push rod 54 is caused to abut on the member to be driven and the push rod 54 moves backward against the spring force, a press detecting sensor (not shown in the drawings) is activated. A trigger 56 is provided on the handle part 11*c*. When the trigger 56 is operated, a trigger switch 57 is activated.

A controller 58 is provided in the housing 11. Detected signals are sent to the controller 58 from the angle detecting sensor, the press detecting sensor, and the trigger switch 57 described above. As shown in FIG. 1 and FIG. 3, when the trigger 56 is operated at the forward limit position in which the piston 13 becomes the tip part of the cylinder 12 and the push rod 54 is caused to abut on the member to be driven to turn on the trigger switch 57, the electric motor 33 is driven. This causes the rotary disk 26 to be rotationally driven, and the piston 13 is driven to a position of the top part of the cylinder 12. When the engagement of the pin 32 and the rack claw 31*a* is released, the piston 13 is driven to the forward limit position by means of the compressed air in the compression chamber 45, and the fastener is driven to the member to be driven by means of the driver blade 15.

As shown in FIG. 3 and FIG. 4, a flange 61 that abuts on the damper 25 is provided at a base end part of the driver blade 15, and a coupling part 62 projects upward from the flange 61. The coupling part 62 gets into a concave part 63 formed in the piston 13. A long hole 64 extending in a direction of the central axis O1 is provided in the coupling part 62. A piston pin 65 that penetrates the long hole 64 is fitted to the piston 13, and the long hole 64 is larger than a diameter of the piston pin 65. A snap ring 66 that becomes a locking member is fitted to the piston 13, and the snap ring 66 abuts on both end parts of the piston pin 65. A sealing member 67 that seals a space between the piston 13 and the cylinder hole 12*a* is fitted to an outer circumferential part of the piston 13.

In this manner, since the driver blade 15 is mounted on the piston 13 by means of the piston pin 65 that penetrates the long hole 64, the driver blade 15 is configured to be swingable in a radial direction of the piston 13 with respect to the piston 13. Even though the driver blade 15 swings when the piston 13 is driven toward the top part of the cylinder 12 via the driver blade 15 by means of the rotary disk 26, it is possible to prevent an external force in the radial direction from being applied to the piston 13. This makes it possible to smoothly drive the piston 13 by means of the rotary disk 26.

In order to fill the inside of the compression chamber 45 with the compressed air, as shown in FIG. 1, a filling valve 71 is provided on the bottom wall portion 42 of the pressure accumulating container 41. The filling valve 71 is fixed to the bottom wall portion 42 at a base end part thereof by means of a nut 72, and a tip part thereof projects to downward of the bottom wall portion 42, that is, toward the cylinder 12 side. A joint part 73 is provided at the tip part of the filling valve 71. When the compression chamber 45 is filled with the compressed air, a supply port of any of various kinds of compressed gas supplying means, such as a compressor, an air feeder, and a compressed gas cylinder, is connected to the joint part 73. A check valve is assembled inside the filling valve 71. When the supply port of compressed air supplying means is connected to the joint part 73, the check valve is opened, and a compressed gas such as a compressed air is filled in the compression chamber 45. When the supply port is removed from the joint part 73, the filling valve 71 is closed by the check valve.

In order to connect the supply port to the joint part 73 of the filling valve 71, an opening (not shown in the drawings) is provided in the housing 11. When the fastener driving machine 10 is assembled, the compressed air is supplied to the compression chamber 45 by means of the compressed air supplying means by using the filling valve 71. Moreover, in a case where a gas pressure within the compression chamber 45 decreases, the compressed air is supplied to the compression chamber 45 by pressure supplying means. On the other hand, when the cylinder 12 is taken out from the inside of the housing 11, the check valve assembled in the filling valve 71 is operated by means of an operation jig, whereby a gas within the compression chamber 45 is discharged to the outside. Further, a relief valve 81 may be operated similarly to discharge the gas within the compression chamber 45 to the outside.

In order to discharge the compressed air within the compression chamber 45 to the outside in a case where a pressure in the compression chamber 45 exceeds a setting value, the relief valve 81 is provided on the bottom wall portion 42. The setting value is set to a pressure of the compression chamber 45 that is required to drive a fastener with the maximum length, which is to be driven by the fastener driving machine 10.

As shown in FIG. 1 and FIG. 2, the filling valve 71 and the relief valve 81 are provided on the bottom wall portion 42 that projects outward in the radial direction of the cylinder 12. For this reason, a room formed under the bottom wall portion 42, that is, at the cylinder 12 side (hereinafter, referred to as a "space") is utilized, and the filling valve 71 and the relief valve 81 are disposed in the space. This makes it possible to suppress a diameter of the cylinder case part 11*a* from being made larger in size. In particular, as shown in FIG. 1 and FIG. 2, in a case where the filling valve 71 and the relief valve 81 are disposed in a space between the handle part 11*c* and the cylinder 12, the pressure accumulating container 41 is arranged so as to be shifted to the handle part 11*c* side of the cylinder 12 with respect to the central axis O1. Therefore, by effectively utilizing the space under the compression chamber 45, it is possible to dispose the filling valve 71 and the relief valve 81.

As described above, since the filling valve 71 is disposed in the space between the handle part 11*c* and the cylinder 12, it is possible to carry out filling up of the compressed air to the compression chamber 45 easily by using the filling valve 71. Moreover, the relief valve 81 is disposed in the same space for the filling valve 71. In a case where the air (gas) containing oil content and/or moisture content is discharged from the relief valve 81 to the inside of the cylinder case part 11*a* of the housing 11, it is possible to prevent the air from directly blowing against electrical parts or electronic parts.

Figure 6:
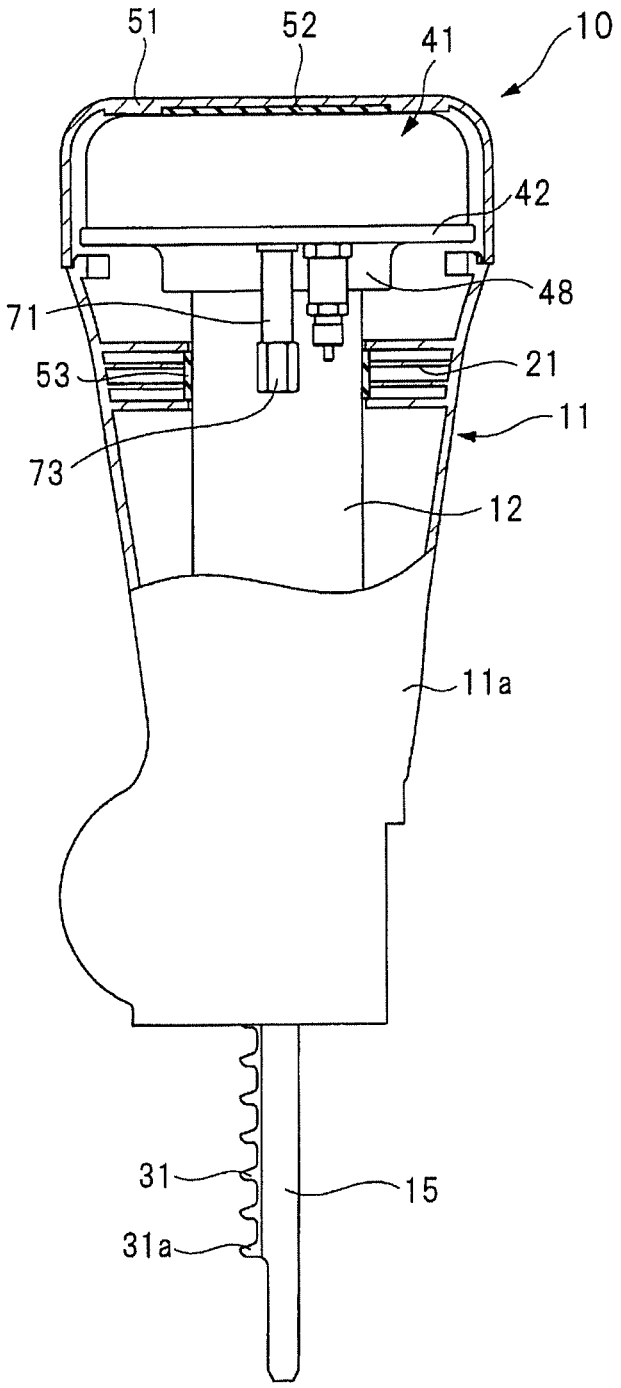
FIG. 6 is a partial cutaway front view of a fastener driving machine according to a modified example.

FIG. 6 is a partial cutaway front view showing a fastener driving machine 10 according to a modified example. In FIG. 6, a filling valve 71 and a relief valve 81 are positioned at a front side of a cylinder 12 and mounted on a bottom wall portion 42. Namely, in the case shown in FIG. 1, the filling valve 71 and the relief valve 81 are disposed between the cylinder 12 and the cylinder case part 11*a* at a back side of the cylinder 12. On the other hand, in the fastener driving machine 10 shown in FIG. 6, the filling valve 71 and the relief valve 81 are disposed at the opposite side to the case shown in FIG. 1 by using the cylinder 12 as an intermediary. In this manner, even in the form where the filling valve 71 and the relief valve 81 are positioned at the front side of the cylinder 12 and are mounted on the bottom wall portion 42 of a pressure accumulating container 41, it is possible to cause the filling valve 71 and the relief valve 81 to project downward by using the bottom wall portion 42 of the pressure accumulating container 41, whose diameter is larger than that of the cylinder 12.

Figure 7:
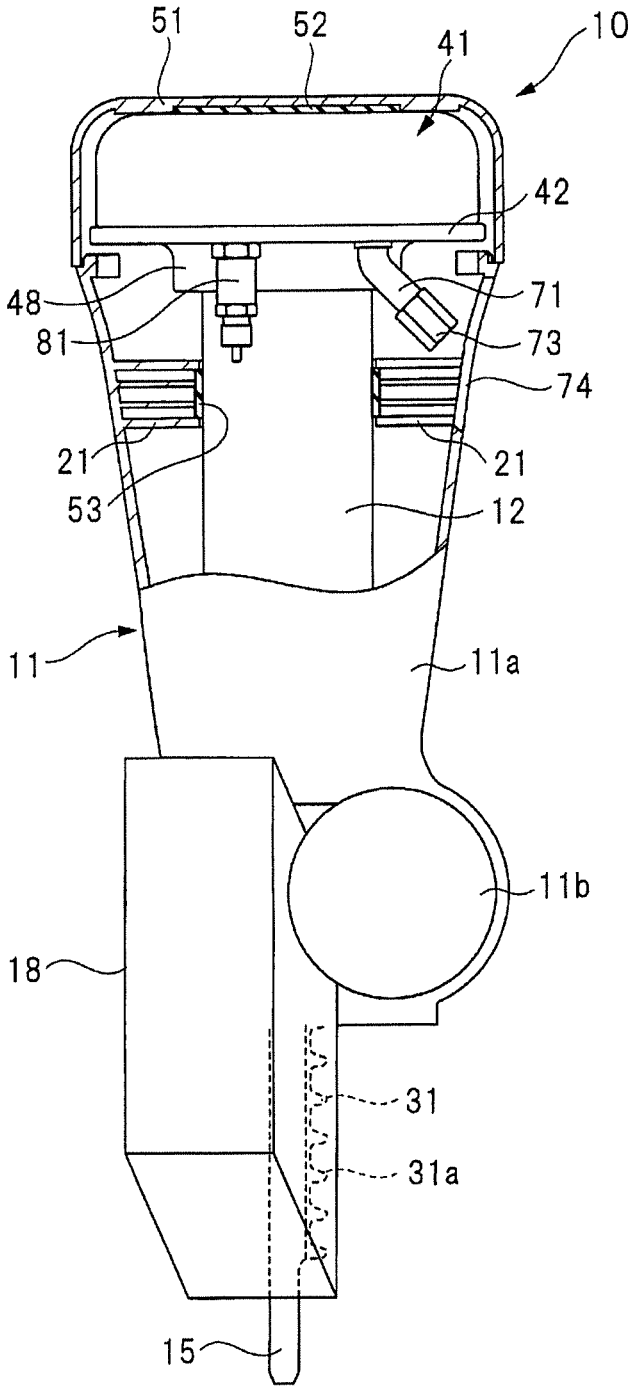
FIG. 7 is a partial cutaway back view of a fastener driving machine according to another modified example when viewed from a magazine side.

FIG. 7 is a partial cutaway back view of the fastener driving machine 10 according to another modified example when viewed from a magazine side. In the fastener driving machine 10, as well as the fastener driving machine shown in FIG. 1, a filling valve 71 and a relief valve 81 is provided in a space between a cylinder 12 and a cylinder case part 11*a*. The filling valve 71 described above is mounted on the bottom wall portion 42 approximately at a right angle, whereas the filling valve 71 shown in FIG. 7 is tilted toward an inner surface of a housing 11. Thus, a joint part 73 provided at a tip part of the filling valve 71 approaches the inner surface of the housing 11. By adopting a tilted structure for the filling valve 71 in this manner, it is possible to connect a supply port of compressed gas supplying means to the joint part 73 easily. In order to connect the supply port to the joint part 73 of the filling valve 71, an opening 74 is provided in the housing 11.

Figure 8:
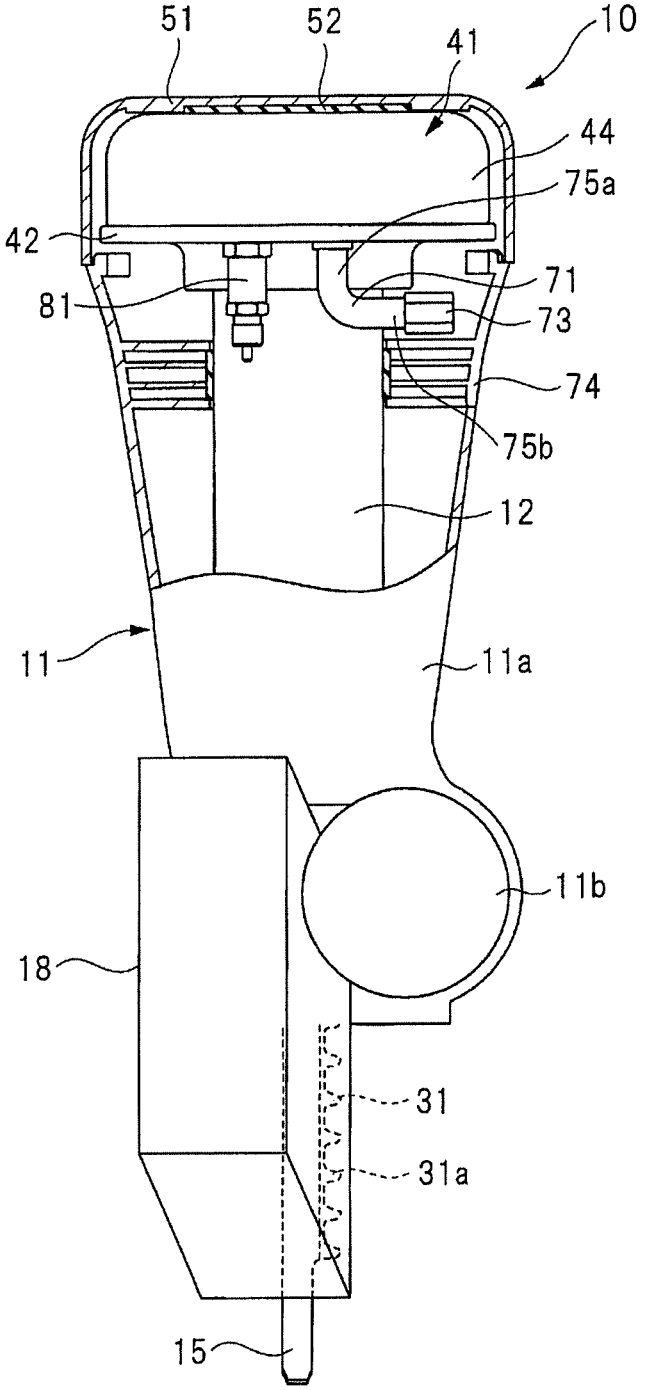
FIG. 8 is a partial cutaway back view of a fastener driving machine according to still another modified example when viewed from a magazine side.

FIG. 8 is a partial cutaway back view of a fastener driving machine 10 according to still another modified example when viewed from the magazine side. A filling valve 71 shown in FIG. 8 has a base part 75*a* and a tip part 75*b*. The base part 75*a* is mounted on a bottom wall portion 42 to become a right angle relative to the bottom wall portion 42. The tip part 75*b* is bent approximately at a right angle relative to the base part 75*a* to be inflected toward a housing 11. A joint part 73 is provided on the tip part 75*b*. By adopting a bent structure for the filling valve 71 in this manner, it is also possible to connect a supply port of compressed gas supplying means to the joint part 73 easily. The supply port is connected to the joint part 73 of the filling valve 71 through an opening 74.

FIG. 7 and FIG. 8 show the case where the filling valve 71 and the relief valve 81 are disposed at the back side of the cylinder 12, that is, in the space between the cylinder 12 and the handle part 11*c*. However, even in a case where they are disposed at the front side of the cylinder 12 as shown in FIG. 6, it is possible to adopt the tilted structure or the bent structure for the filling valve 71.

Figure 9:
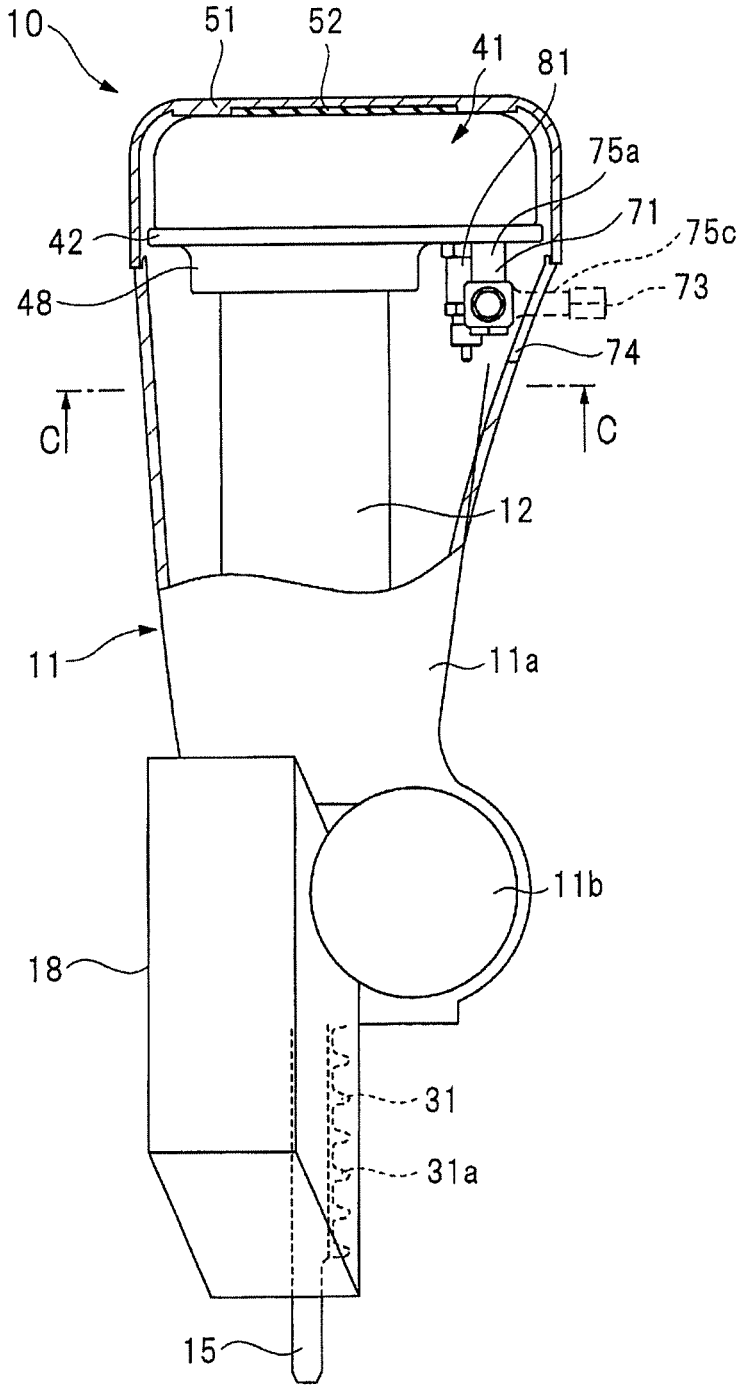
FIG. 9 is a partial cutaway back view of a fastener driving machine according to still another modified example when viewed from a magazine side.
Figure 10:
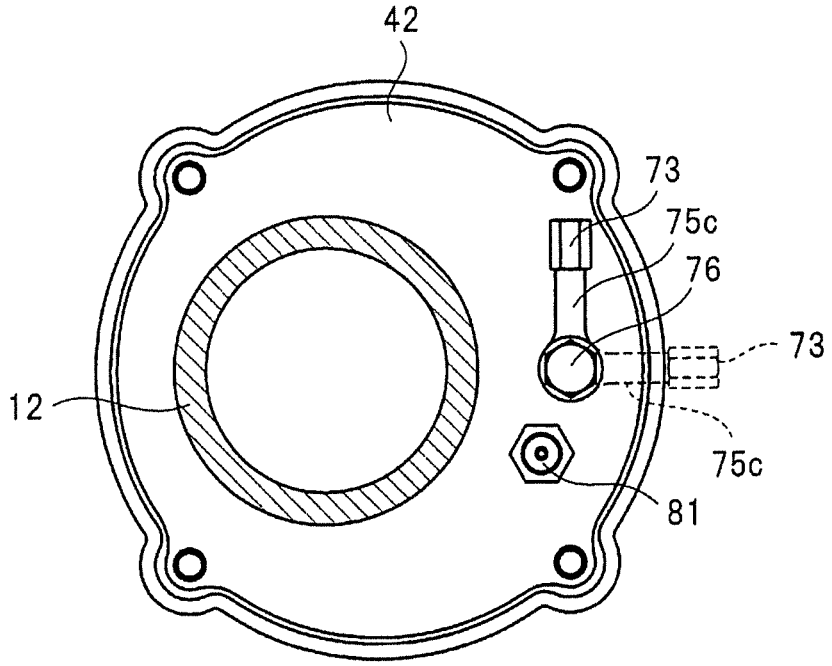
FIG. 10 is a sectional view taken along a C-C line of FIG. 9.

FIG. 9 is a partial cutaway back view of a fastener driving machine 10 according to still another modified example when viewed from a magazine side. FIG. 10 is a sectional view taken along a C-C line of FIG. 9. In the fastener driving machine 10 shown in FIG. 9, a pressure accumulating container 41 is shifted to a right side in FIG. 9, that is, to a right side when viewed from the front, and a filling valve 71 and a relief valve 81 are fitted to a bottom wall portion 42 of the pressure accumulating container 41, which is shifted laterally with respect to a cylinder 12. The filling valve 71 has a base part 75*a* and a rotary part 75*c*. The base part 75*a* is mounted on the bottom wall portion 42 to become a right angle relative to the bottom wall portion 42. The rotary part 75*c* is rotatably coupled to the base part 75*a* via a rotary joint 76. The rotary part 75*c* is bent in a direction substantially perpendicular to the base part 75*a*. When a joint part 73 provided on the rotary part 75*c* is rotated, the rotary part 75*c* projects from an opening 74 as shown with a broken line in FIG. 10. By adopting a rotary type for the filling valve 71 in this manner, it is possible to connect a supply port of compressed gas supplying means to the joint part 73 easily.

In a case where the filling valve 71 and the relief valve 81 are disposed at the right side in FIG. 9, that is, at a motor case part 11*b* side, they are caused not to protrude laterally from the motor case part 11*b*. The filling valve 71 and the relief valve 81 may be disposed at the opposite side to the case of FIG. 9, that is, at a magazine 18 side. In such a case, the filling valve 71 and the relief valve 81 are also caused not to protrude laterally from the magazine 18. In a case where the filling valve 71 and the relief valve 81 are disposed at any side of the right and left sides of the pressure accumulating container 41 in this manner, it is possible cause a handle part 11*c* to approach the cylinder 12. This makes it possible to improve operability of the fastener driving machine 10. Further, the filling valve 71 and the relief valve 81, which have the structure shown in FIG. 9, may be disposed at the position shown in FIG. 1.

Figure 11:
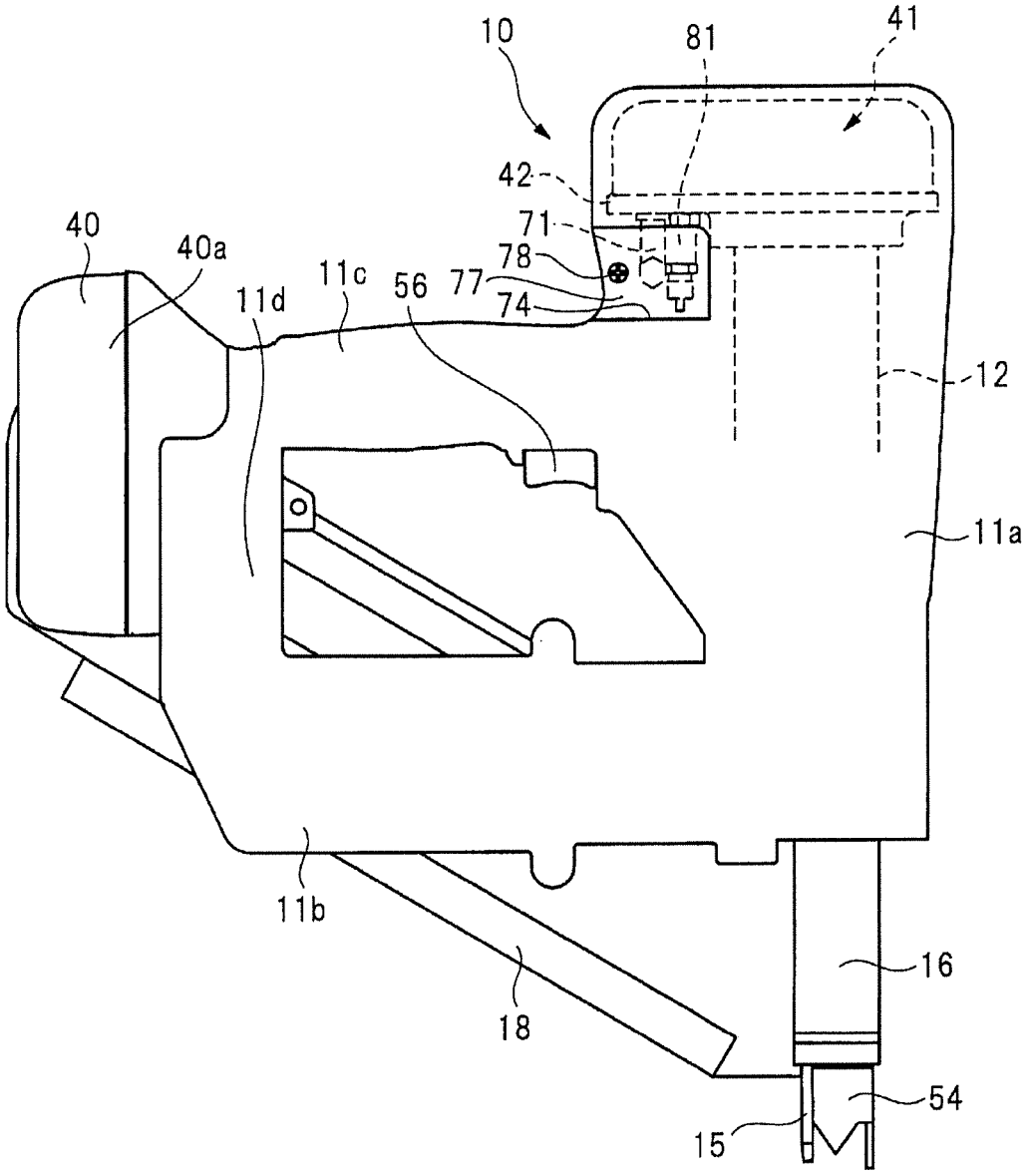
FIG. 11 is a side view of the fastener driving machine in which a lid member provided in a housing is shown.

FIG. 11 is a side view of the fastener driving machine in which a lid member provided in a housing is shown. An opening 74 is provided at a portion facing a filling valve 71 on a cylinder case part 11*a* of a housing 11. A lid member 77 is detachably provided on the opening 74. The lid member 77 is fixed to the housing 11 by means of a screw member 78. When the screw member 78 is loosened and the lid member 77 is detached, the filling valve 71 and a relief valve 81 are exposed to the outside. In an exposed state, a supply port of compressed gas supplying means is connected to a joint part 73 of the filling valve 71.

Figure 12:
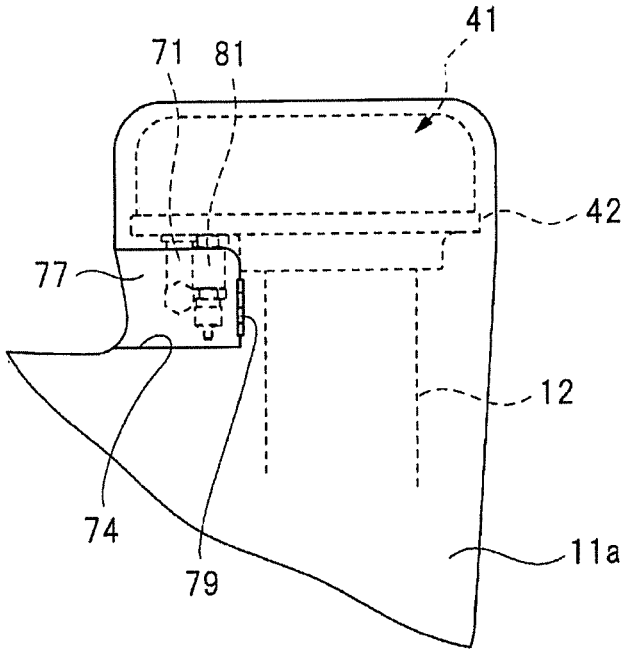
FIG. 12 is a side view showing apart of the fastener driving machine in which a lid member according to a modified example is provided.

FIG. 12 is a side view showing apart of the fastener driving machine in which a lid member according to a modified example is provided. A lid member 77 shown in FIG. 12 is provided in a housing 11 so that the lid member 77 can be opened and closed by a hinge part 79. In this manner, an opening and closing system of the lid member 77 may be a detachable type as shown in FIG. 11 or an opening/closing type. FIG. 11 and FIG. 12 show the case where the filling valve 71 and the relief valve 81 are disposed in a space at a back surface side of a cylinder 12 between the cylinder 12 and a handle part 11*c* as shown in FIG. 1. However, the lid member 77 can similarly be provided in a case where they are disposed in a space at a front surface side of the cylinder 12 as shown in FIG. 6 to FIG. 8, or in a case where they are disposed in a space at a side surface of the cylinder 12 as shown in FIG. 9.

Figure 13:
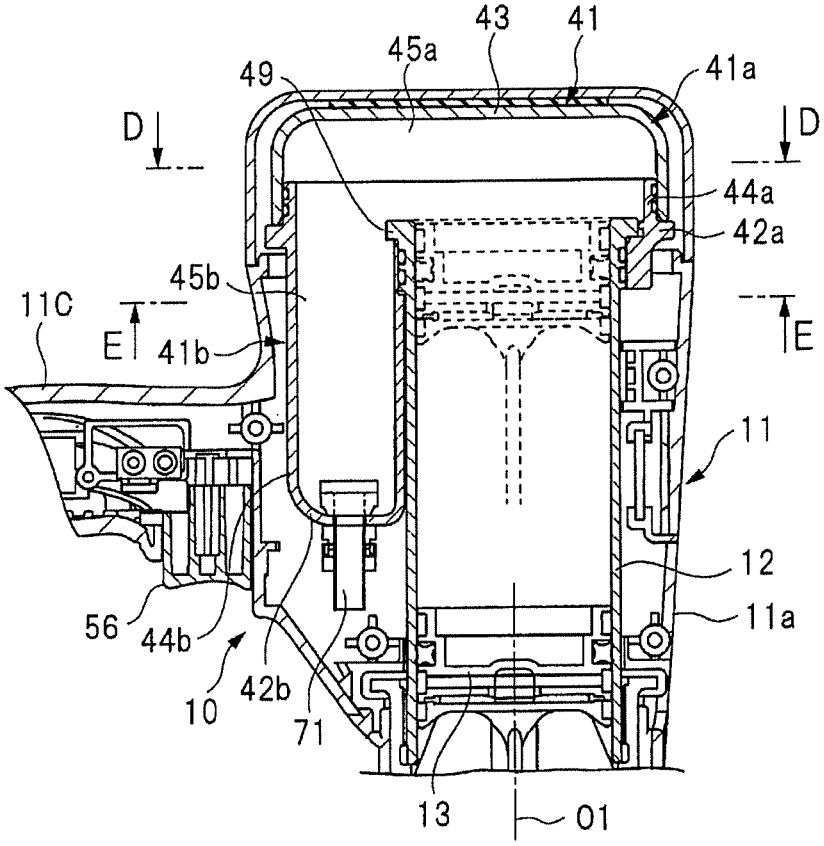
FIG. 13 is a sectional view of a side surface showing a main part of a fastener driving machine according to another embodiment.
Figure 14:
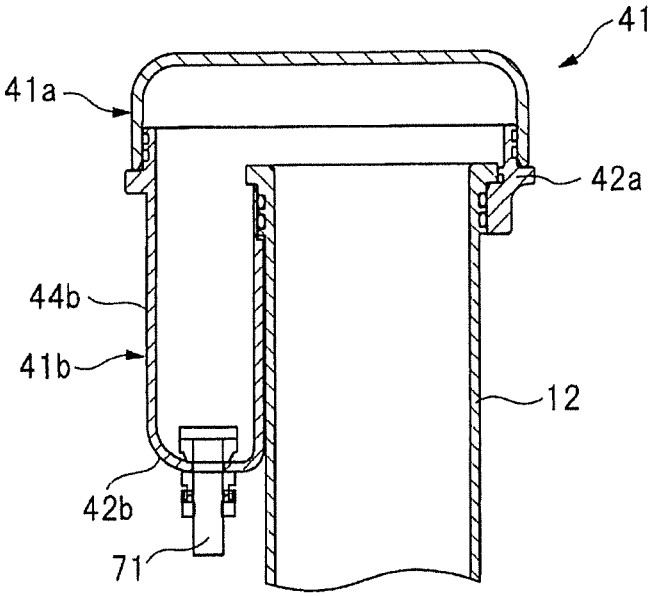
FIG. 14 is an enlarged sectional view showing a pressure accumulating container shown in FIG. 13.
Figure 15:
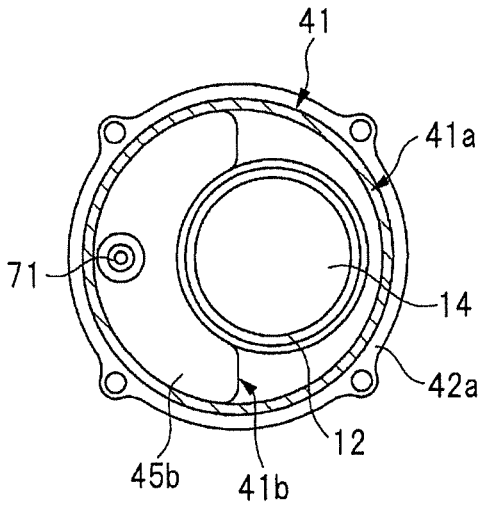
FIG. 15 is a sectional view taken along a D-D line of FIG. 13.
Figure 16:
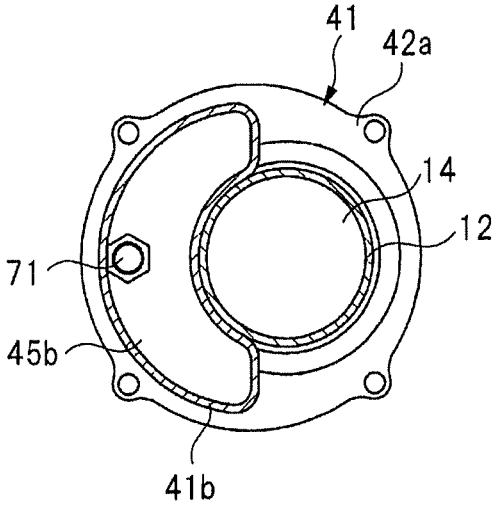
FIG. 16 is a sectional view taken along an E-E line of FIG. 13.

FIG. 13 is a sectional view of a side surface showing a main part of a fastener driving machine 10 according to another embodiment. FIG. 14 is an enlarged sectional view showing a pressure accumulating container shown in FIG. 13. FIG. 15 is a sectional view taken along a D-D line of FIG. 13. FIG. 16 is a sectional view taken along an E-E line of FIG. 13. A portion in FIG. 13 whose illustration is omitted is similar to that in the fastener driving machine 10 shown in FIG. 1.

In the fastener driving machine 10 shown in FIG. 13, as shown in FIG. 14, a pressure accumulating container 41 has a first pressure accumulating container 41*a* and a second pressure accumulating container 41*b*. The first pressure accumulating container 41*a* is provided outward in an axial direction of a cylinder 12, and has a first bottom wall portion 42*a* mounted on a top part of the cylinder 12. In the pressure accumulating container 41*a*, a cylindrical part 44*a* that is integrated with a top wall portion 43 is mounted on the bottom wall portion 42*a*, and the top wall portion 43 faces the top part of the cylinder 12 and the bottom wall portion 42*a*. A first a compression chamber 45*a* that communicates with a piston chamber 14 is formed inside the first pressure accumulating container 41*a*. In the similar manner to the bottom wall portion 42 of the pressure accumulating container 41 shown in FIG. 1, an outer peripheral surface of the bottom wall portion 42*a* is formed by a member having a round shape, and the bottom wall portion 42*a* is shifted in a radial direction toward a handle part 11*c* with respect to the cylinder 12. Therefore, the compression chamber 45*a* of the first pressure accumulating container 41*a* is eccentrically provided with respect to a central axis O1 of the cylinder 12.

The second pressure accumulating container 41*b* projects downward from the bottom wall portion 42*a* along the cylinder 12 by using an opening 49 formed at the first bottom wall portion 42*a* as a base end part. A second compression chamber 45*b* in the pressure accumulating container 41*b* extends along the cylinder 12. The second pressure accumulating container 41*b* has a second bottom wall portion 42*b* and a second cylindrical part 44*b*. The second bottom wall portion 42*b* extends to the outward of the cylinder 12 so as to face the opening 49. The second cylindrical part 44*b* is integrally formed with the second bottom wall portion 42*b*. The second compression chamber 45*b* communicates with the piston chamber 14 via the first the compression chamber 45*a*. As shown in FIG. 14 and FIG. 15, a transverse section of the second compression chamber 45*b* becomes an arc shape so as to partially enclose the cylinder 12.

By shifting the second pressure accumulating container 41*b* in the radial direction thereof with respect to the first pressure accumulating container 41*a* and arranging the second pressure accumulating container 41*b* in the reverse direction in this manner, it is possible to increase a volume of the compressed air to be accumulated by means of both of the compression chambers 45*a*, 45*b* compared with the case shown in FIG. 1.

As shown in FIG. 13, the filling valve 71 is provided on the second bottom wall portion 42*b* so as to project downward. In this case, by utilizing a space between the cylinder 12 and the handle part 11*c*, it is possible to dispose the filling valve 71 at a position shifted in the radial direction with respect to the cylinder 12.

Figure 17:
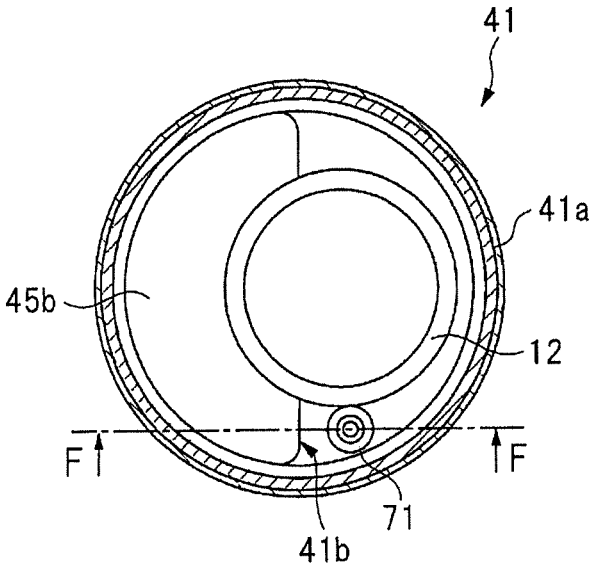
FIG. 17(A) is a plan view showing another modified example of the pressure accumulating container shown in FIG. 13.
FIG. 17(B) is a sectional view taken along an F-F line of FIG. 17(A).
Figure 17:
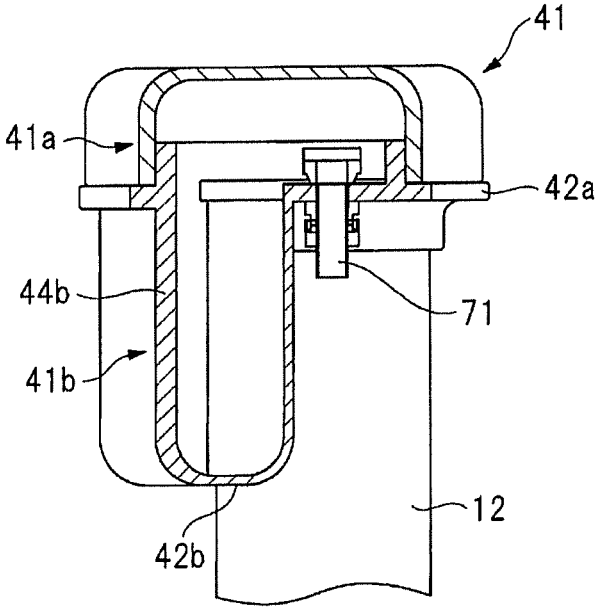

FIG. 17(A) is a plan view showing another modified example of the pressure accumulating container shown in FIG. 13, and FIG. 17(B) is a sectional view taken along an F-F line of FIG. 17(A).

As well as the case shown in FIG. 13, a pressure accumulating container 41 has a first pressure accumulating container 41*a* and a second pressure accumulating container 41*b*. A filling valve 71 is provided on a first bottom wall portion 42*a* unlike the case shown in FIG. 13. The filling valve 71 is provided on the bottom wall portion 42*a* so as to be shifted to a side surface of the fastener driving machine 10, that is, at a lower side in FIG. 17(A). Since the filling valve 71 is disposed in this manner, it is possible to use a gap between the pressure accumulating container 41*b* and a housing 11 effectively. This makes it possible to downsize the fastener driving machine 10. However, the filling valve 71 may be provided so as to be shifted at an upper side in FIG. 17(A). Alternatively, the filling valve 71 may be provided on the bottom wall portion 42*a* so as to be shifted to a front surface side of the fastener driving machine 10.

Figure 18:
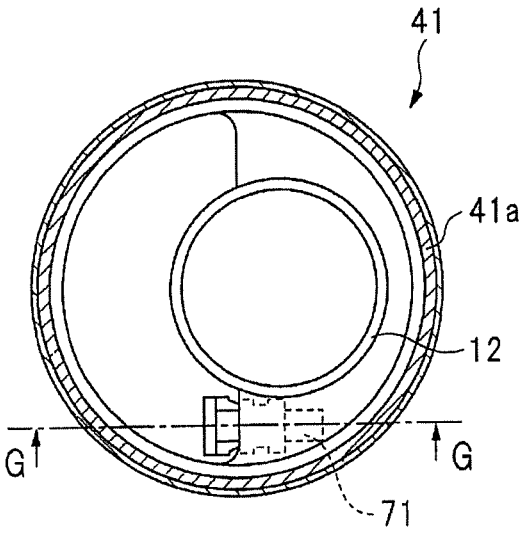
FIG. 18(A) is a plan view showing still another modified example of the pressure accumulating container shown in FIG. 13.
FIG. 18(B) is a sectional view taken along a G-G line of FIG. 18(A).
Figure 18:
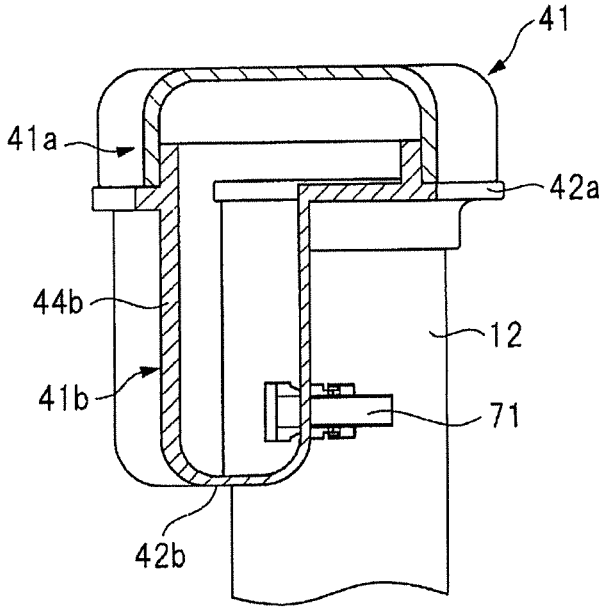

FIG. 18(A) is a plan view showing still another modified example of the pressure accumulating container shown in FIG. 13. FIG. 18(B) is a sectional view taken along a G-G line of FIG. 18(A). In a fastener driving machine 10, a filling valve 71 is disposed on a cylindrical part 44*b* of a second pressure accumulating container 41*b*, that is, on a side wall. In a case where the filling valve 71 is disposed on the side wall of the pressure accumulating container 41*b* in this manner, it is possible to utilize a gap between the pressure accumulating container 41*b* and a housing 11, and this makes it possible to downsize the fastener driving machine 10.

Moreover, in the embodiment described above, the case where the present invention is applied to a DC motor (DC inverter motor) using a battery as a power source has been described. However, the present invention is not limited to this, and the present invention may be applied to a motor (AC inverter motor) using an AC power source. Further, an AC-DC converter may be used in place of the battery. An electric power may be supplied to a DC motor (DC inverter motor) in the fastener driving machine by converting a commercial power supply (AC power supply) into a DC power supply.

The present invention is not limited to the embodiments, and various modifications can be made without departing from the substance thereof.

EXPLANATION OF REFERENCE NUMERALS

10 . . . fastener driving machine, 11 . . . housing, 11*a* . . . cylinder case part, 11*b* . . . motor case part, 11*c* . . . handle part, 12 . . . cylinder, 13 . . . piston, 14 . . . piston chamber, 15 . . . driver blade, 16 . . . nose part, 17 . . . injection port, 18 . . . magazine, 23 . . . holder, 24, 24*a* . . . through hole, 25 . . . damper, 26 . . . rotary disk, 27 . . . drive shaft, 31 . . . rack, 31*a* . . . rack claw, 32 . . . pin, 33 . . . electric motor, 34 . . . motor shaft, 35 . . . cooling fan, 36 . . . speed reducer, 39 . . . speed reducer holder, 40 . . . battery, 41 . . . pressure accumulating container, 41*a* . . . first pressure accumulating container, 41*b* . . . second pressure accumulating container, 42 . . . bottom wall portion, 42*a* . . . first bottom wall portion, 42*b* . . . second bottom wall portion, 43 . . . top wall portion, 44 . . . cylindrical part, 44*a* . . . first cylindrical part, 44*b* . . . second cylindrical part, 45 . . . compression chamber, 45*a* . . . first compression chamber, 45*b* . . . second compression chamber, 48 . . . projecting part, 49 . . . opening, 51 . . . cover, 54 . . . push rod, 55 . . . helical compression spring, 56 . . . trigger, 57 . . . trigger switch, 58 . . . controller, 61 . . . flange, 62 . . . coupling part, 63 . . . concave part, 64 . . . long hole, 65 . . . piston pin, 66 . . . snap ring, 67 . . . sealing member, 71 . . . filling valve, 72 . . . nut, 73 . . . joint part, 74 . . . opening, 75*a* . . . base part, 75*b* . . . tip part, 75*c* . . . rotary part, 76 . . . rotary joint, 77 . . . lid member, 78 . . . screw member, 79 . . . hinge part, 81 . . . relief valve

The invention claimed is:

1. A fastener driving machine comprising:

a cylinder having a first side and a second side opposite to the first side;

a piston inserted into the cylinder and allowed to reciprocate in the cylinder to drive a driver blade so that a fastener is driven into a member, the first side of the cylinder being on a side of a bottom dead center of the piston;

a housing including a cylinder case housing the cylinder, and a handle extending from the cylinder case in a first direction crossing an axial direction of the cylinder;

a pressure accumulating container disposed on the second side of the cylinder, the pressure accumulating container comprising:

a bottom wall having (1) a first cylindrical portion coupled to the second side of the cylinder, (2) a bottom portion extending outwardly from the first cylindrical portion, the bottom portion having a round shape in an axial-direction view of the cylinder, and (3) a second cylindrical portion disposed along a periphery of the round-shaped bottom portion; and a top wall having a third cylindrical portion coupled to the second cylindrical portion of the bottom wall, wherein in the axial-direction view of the cylinder, the round-shaped bottom portion is so formed relative to the first cylindrical portion that a center of the round-shaped bottom portion is offset from a center of the cylinder in the first direction toward the handle.

2. The fastener driving machine according to claim 1, further comprising a filling valve provided on the bottom wall to fill the pressure accumulating container with a gas.

3. The fastener driving machine according to claim 1, wherein the cylinder includes a connecting portion to be connected to the bottom wall.

4. The fastener driving machine according to claim 1, wherein the bottom wall has a concave part that extends along the axial direction of the cylinder, and wherein the pressure accumulating container includes:

a first compression chamber provided on the second side of the cylinder; and a second compression chamber formed by the concave part.

5. The fastener driving machine according to claim 2, wherein the filling valve is disposed in a space between the handle and the cylinder.

6. The fastener driving machine according to claim 2, wherein the filling valve is tilted toward an inner wall of the housing, and a joint part is provided at a tip of the filling valve, the joint part being adjacent to the inner wall of the housing.

7. The fastener driving machine according to claim 2, wherein the filling valve has a base part and a tip part, the base part being mounted on the bottom wall, the tip part being bent toward an inner wall of the housing from the base part, a joint part being provided at a tip of the tip part.

8. The fastener driving machine according to claim 2, wherein the filling valve has a base part and a rotary part, the base part being mounted on the bottom wall, the rotary part being rotatably coupled to the base part, the rotary part being bent toward an inner wall of the housing from the base part, a joint part being provided at a tip of the rotary part.

9. The fastener driving machine according to claim 2, wherein the housing includes a lid configured to expose the filling valve to outside.

10. The fastener driving machine according to claim 9, wherein the lid is detachably attached to the housing by a screw.

11. The fastener driving machine according to claim 9, further comprising a hinge to attach the lid to the housing.

12. The fastener driving machine according to claim 1, further comprising a relief valve provided on the bottom wall, the relief valve being configured to discharge a gas to outside.

13. The fastener driving machine according to claim 1, further comprising:

a ring-shaped first sealing member disposed between an outer circumferential surface of the cylinder and the first cylindrical portion of the bottom wall; and a ring-shaped second sealing member disposed between the second cylindrical portion of the bottom wall and the third cylindrical portion of the top wall.

14. The fastener deriving machine according to claim 13, wherein the first cylindrical portion overlaps with the outer circumferential surface of the cylinder to sandwich the ring-shaped first sealing member therebetween in a radial direction of the cylinder, and the second cylindrical portion overlaps with the third cylindrical portion to sandwich the ring-shaped second sealing member therebetween in the radial direction of the cylinder.

15. A fastener driving machine comprising:

a cylinder having a first side and a second side opposite to the first side;

a piston inserted into the cylinder and allowed to reciprocate in the cylinder to drive a driver blade so that a fastener is driven into a member, the first side of the cylinder being on a side of a bottom dead center of the piston;

a housing including a cylinder case housing the cylinder, and a handle extending from the cylinder case in a first direction crossing an axial direction of the cylinder;

a pressure accumulating container disposed on the second side of the cylinder, the pressure accumulating container comprising:

a bottom wall having (1) a first cylindrical portion coupled to the second side of the cylinder, (2) a bottom portion extending outwardly from the first cylindrical portion, the bottom portion having a round shape in an axial-direction view of the cylinder, and (3) a second cylindrical portion disposed along a periphery of the round-shaped bottom portion; and a top wall having a third cylindrical portion coupled to the second cylindrical portion of the bottom wall, wherein the first cylindrical portion overlaps with an outer circumferential surface of the cylinder to sandwich a ring-shaped first sealing member therebetween in a radial direction of the cylinder, and wherein the second cylindrical portion overlaps with the third cylindrical portion to sandwich a ring-shaped second sealing member therebetween in the radial direction of the cylinder.

* * * * *